US006793688B2

(12) United States Patent
Tyler et al.

(10) Patent No.: US 6,793,688 B2
(45) Date of Patent: Sep. 21, 2004

(54) METHOD OF IMPRINTING IMAGE ON SOFT SURFACE

(75) Inventors: Timothy G. Tyler, Costa Mesa, CA (US); Ryan K. Mizell, Costa Mesa, CA (US); Juan M. Figueroa, Stanton, CA (US)

(73) Assignee: Logotec USA, LLC, Sierra Madre, CA (US)

( * ) Notice: Subject to any disclaimer, the term of this patent is extended or adjusted under 35 U.S.C. 154(b) by 0 days.

(21) Appl. No.: 10/054,045

(22) Filed: Jan. 22, 2002

(65) Prior Publication Data

US 2003/0135938 A1 Jul. 24, 2003

(51) Int. Cl.[7] ..... B44C 1/165; D06P 5/26

(52) U.S. Cl. ..... 8/470; 427/195; 427/202; 427/203; 156/230

(58) Field of Search ..... 8/470; 427/195, 427/202, 203; 156/230; 7/467–471

(56) References Cited

U.S. PATENT DOCUMENTS 4,037,008 A * 7/1977 Tugwell
4,292,103 A * 9/1981 Namura et al. ..... 156/230
4,351,871 A 9/1982 Lewis et al. ..... 428/195
4,402,405 A 9/1983 Fullalove ..... 369/271
4,565,842 A 1/1986 Fitzer et al. ..... 524/57
4,623,686 A * 11/1986 Hurnik et al.
5,284,918 A 2/1994 Huynh-Tran et al. ..... 525/124
5,820,929 A * 10/1998 Chi ..... 427/195
6,111,048 A 8/2000 Asahina et al. ..... 528/45
6,143,115 A * 11/2000 Sammis

* cited by examiner

*Primary Examiner*—Margaret Einsmann
(74) *Attorney, Agent, or Firm*—Cohen Sakaguchi & English LLP

(57) ABSTRACT

A method is described herein for imprinting an image on a soft surface typically embodied in a consumer article. The image is formed using an ink compound comprising ink and aromatic polyisocyanates, to provide improved attachment of the image to the surface using the method described herein. For imprinting a single-color image on a surface, the method typically includes providing the image on heat transfer paper, applying powder to the image, applying heat to the heat transfer paper after applying the powder, positioning the heat transfer paper with the image thereon against the surface, applying heat and pressure to the heat transfer paper against the surface to cause the heat transfer paper with the image thereon to attach to the surface, removing the heat transfer paper from the surface such that the image remains on the surface, and applying heat to the surface after removing the heat transfer paper from the surface. For imprinting a multi-color image on the surface, the heat transfer paper is preheated prior to forming any image thereon. Further, each color is applied separately, and the heat transfer paper is heated after application of each color. The powder is applied only after all colors have been applied to the heat transfer paper to form the multi-color image.

52 Claims, 2 Drawing Sheets

Fig. 3a
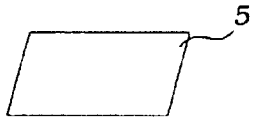
Fig. 3b
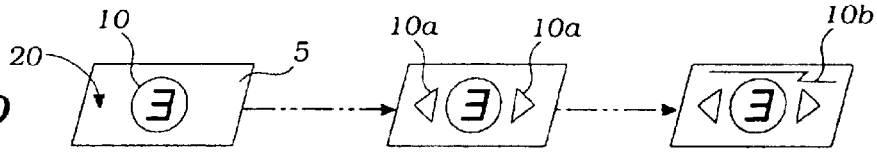
Fig. 3c
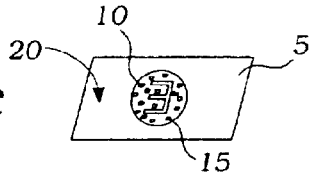
Fig. 3d
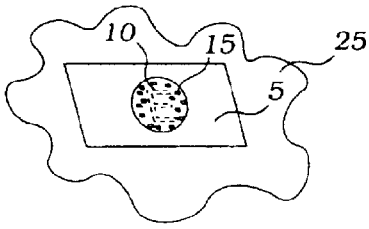
Fig. 3
Fig. 3e
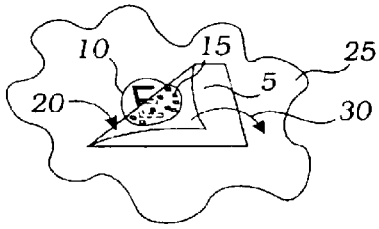
Fig. 3f
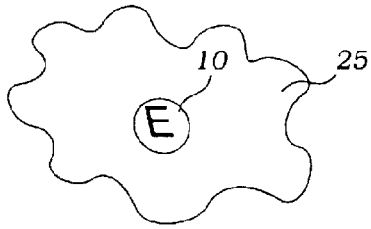

METHOD OF IMPRINTING IMAGE ON SOFT SURFACE

FIELD OF THE INVENTION

The present invention relates generally to imprinting, and more particularly to a method of imprinting an image on a soft surface such as: a handbag; backpack; appointment book; carrying bag; sports bag; gym bag; briefcase; luggage; cooler; beverage holder; lunch box; a nylon, polyester, or cotton article; a soft-sewn article; polyvinyl chloride (PVC) and PVC derivatives.

INCORPORATION BY REFERENCE

The contents of each U.S. patent or other reference, if any, cited in this application, are hereby incorporated herein by reference.

BACKGROUND OF INVENTION

Silk screening and other imprinting processes are common for transferring images onto items such as T-shirts, etc. For example, in a direct screening process, wet ink is forced through a screen onto the target surface. The ink has some inherent adhesive properties, but nonetheless may bleed causing fuzzy image edges. In addition, known direct screening processes are not suitable for certain target materials such as PVC and PVC derivatives. For multi-color images, typically multiple screens are used successively. In such instances, problems may arise due to misalignment of a subsequent screen, resulting in a misaligned image and therefore a non-desirable image on the target surface. Further, the multi-color process may require extra waiting time to allow one color to dry before a subsequent color is applied, or else the wet ink from different colors may bleed together.

In known heat transfer methods, an image is applied to heat transfer paper with ink, and is then transferred to the target surface through heat and pressure. Again, the ink has some inherent adhesive properties, but problems arise which cause the transferred image to separate from the target surface under various environmental conditions. Also, known heat transfer methods are not suitable for certain target materials such as PVC and PVC derivatives.

Accordingly, there is a need for an alternative and improved method of imprinting images on soft surfaces, to overcome the above-identified drawbacks, and to provide a more durable and more accurate image.

SUMMARY

The present invention describes a method of imprinting images on a soft surface, such as: a handbag; backpack; appointment book; carrying bag; sports bag; gym bag; briefcase; luggage; cooler; beverage holder; lunch box; a nylon, polyester, or cotton article; a soft-sewn article; polyvinyl chloride (PVC) and PVC derivatives. The method of the present invention uses an ink compound comprising ink and aromatic polyisocyanates, to provide a more durable image on the target surface as described herein.

Once a film positive of the image is created, a screen is developed as is known in the art. A press is set up which may include custom rigging to accommodate the particular dimensions and other characteristics of the article embodying the target surface. A sheet of heat transfer paper, on which the image is initially provided, is cut to desired dimensions if necessary. The desired dimensions may include calculations to accommodate multiple copies of the image on a single sheet of heat transfer paper, to be subsequently separated into individual images.

To prepare the ink compound, the ink of desired color is mixed with aromatic polyisocyanates in desired proportions, typically in a ratio of approximately 2–40 parts ink to 1 part aromatic polyisocyanates. The ink may be polyvinyl chloride plastisol silk screen ink, commonly available. The ink compound is then used to screen a reverse of the target image onto the image side of the heat transfer paper. The reverse image is then coated with dry powder, such as thermoplastic co-polyamides. The heat transfer paper with the ink compound and powder thereon is then heated/cured, typically in an oven for 2–30 seconds at 100–350 degrees Fahrenheit. If multiple images have been created on a single sheet of heat transfer paper, the multiple images are then separated into individual images by cutting, shearing, etc.

The image has now been prepared for application onto the target surface, typically the soft-sewn surface of a consumer product/article such as a handbag or the like. The product is secured to an apparatus on a heat/pressure press such as a heat stamping machine or a heat transfer machine. The apparatus is typically custom-designed to accommodate the desired product. The image is then applied to the target surface by pressing the heat transfer paper (image side down) onto the surface at the desired location at suitable temperatures and pressures for a suitable duration. Typically, the temperature, pressure, and time variables are in the range of 100–400 degrees Fahrenheit, 30–120 pounds per square inch (psi), and 2–40 seconds, respectively. During the application process, the temperature and pressure variables need not be constant for the entire duration.

The process thus described results in the image on the target surface being the reverse of the image as viewed from the image side of the heat transfer paper after originally being placed thereon. However, as used herein, "image" refers to a visually identifiable image, regardless of orientation. For example, once the ink compound is applied to the heat transfer paper as described herein, an "image" appears on the heat transfer paper. Similarly, once powder is applied thereto, the "image" still appears, though it may appear powdery or coated. Similarly, once the ink compound with the powder is transferred from the heat transfer paper to the target surface, the target surface contains the "image", even though the image on the target surface is the reverse of the image as it may have been viewed from the image side of the heat transfer paper prior to application to the target surface. "Reverse image" and similar terms are used herein merely to facilitate understanding of the process. Thus, "image" is not to be limited to any particular orientation thereof, though a particular reference to an image may be understood to be the reverse of another reference to the same image depending on the relative relation of each of the references to each other during the process as described herein.

After the image is applied to the target surface, the product embodying the target surface is disengaged from the apparatus, and set to cool. The heat transfer paper is then removed from the product, typically by peeling the heat transfer paper away therefrom. The surface with the image thereon may then be heated at suitable temperatures for a suitable duration. Typically, the temperature and time variables are in the range of 220–400 degrees Fahrenheit, and 10–60 seconds respectively. The specific values of those variables may depend on the characteristics of the product, including material composition, thickness, and overall dimensions, and for any particular product may be determined by a minimal amount of trial and error. This final heating is typically performed in a curing tunnel. This final heating results in the ink compound fusing to the target surface, because elasticizers in the ink compound/powder combination are loosened and activated, and molecules on the target surface are separated, all of which facilitates the image (embodied in the ink compound/powder combination) fusing to the target surface. In addition, the final heating causes small traces of excess powder to evaporate. The product with the image thus imprinted thereon is then ready to cool, pack, and distribute.

For application of a multi-color image, desired colored inks are used to form multiple ink compounds, and each color is applied to the heat transfer paper independently such that together they form the desired multi-color image with little or no overlap between the individual colors. Backer film may be used to ensure fine lines and colors. The heat transfer paper is initially heated prior to application of the first color, to shrink the paper thus avoiding further shrinkage between color applications which might otherwise cause misalignment of the various colors with respect to the overall multi-color image. Additionally, the heat transfer paper is heated after application of each color, and the powder is applied preferably only after all colors have been applied and heated.

The invention as described herein thus provides an alternative and improved method of imprinting an image on a soft surface, which overcomes the drawbacks of known methods, and provides a more durable image on the target surface. Further objects and advantages of the present invention are discussed in the detailed description which follows, read in conjunction with the drawings:

BRIEF DESCRIPTION OF THE DRAWINGS

FIGS. 3*a*–3*f* illustrate various stages of a method of imprinting an image on a soft surface in accordance with the present invention, in which:

FIG. 3*a* shows a blank sheet of heat transfer paper;

FIG. 3*b* shows the sheet of heat transfer paper after an image has been formed thereon;

FIG. 3*c* shows the sheet of heat transfer paper after the image has been formed thereon and powder has been applied to the image;

FIG. 3*d* shows the sheet of heat transfer paper placed against the target surface, image side down;

FIG. 3*e* shows the sheet of heat transfer paper being lifted away from the target surface, leaving the image on the surface;

FIG. 3*f* shows the surface with the image thereon.

DETAILED DESCRIPTION

The present invention describes a method of imprinting an image on a soft surface typically embodied in a soft consumer article. The image is formed on heat transfer paper using an ink compound comprising ink and aromatic polyisocyanates. As described more fully herein, the method includes application of powder to the ink compound on the heat transfer paper. The combination of the ink compound and the powder as described herein facilitates the creation of a more durable image on the target surface.

Figure 1:
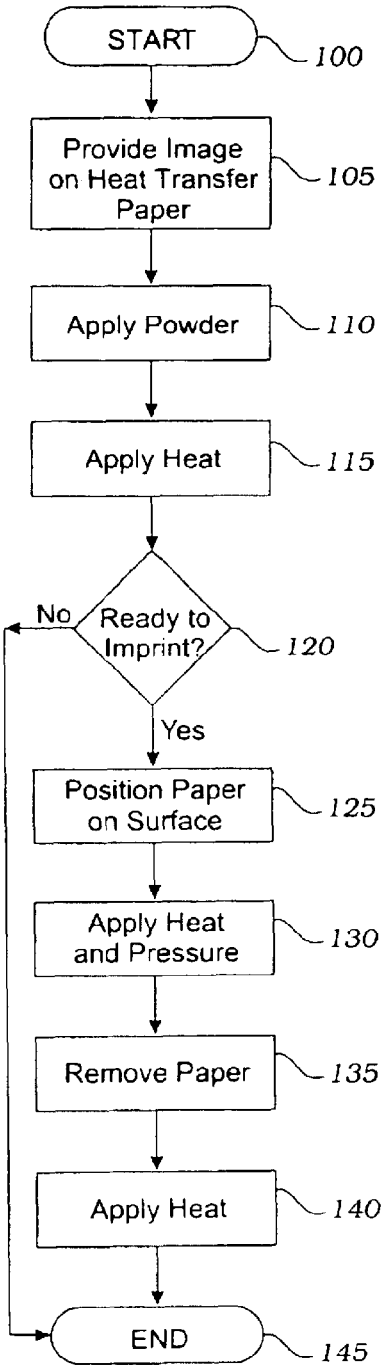
FIG. 1 is a flowchart illustrating a method of imprinting a single-color image on a soft surface in accordance with the present invention.

Turning now to FIG. 1, a flowchart is shown illustrating a method of imprinting a single-color image on a soft surface in accordance with the present invention. The process begins at step 100. At step 105, an image is provided on heat transfer paper (cross reference FIG. 3*b*). Heat transfer paper as is known in the art may be used, as may other suitable papers. The side of the heat transfer paper on which the image is formed is referred to herein as the image side. The opposite side may be referred to as the back side. Though a series of images for application to a series of articles may be provided on the heat transfer paper, the present discussion will refer to a single image for the sake of simplicity. The heat transfer paper with the image thereon may be preformed, or it may be formed as part of the process of the present invention. In either case, the image is formed with an ink compound comprising ink and aromatic polyisocyanates.

The ink may be silk screen printing ink, also known as polyvinyl chloride plastisol silk screen ink, and is available from, for example, International Coatings Company, Inc. of Cerritos, Calif. The aromatic polyisocyanates is also available from, for example, International Coatings Company, Inc. The ratio of ink to aromatic polyisocyanates is at least approximately 2 parts ink to 1 part aromatic polyisocyanates. The ratio can vary significantly depending on a particular application, and a ratio of approximately 10–18 or 14–16 or up to approximately 40 parts ink, to 1 part aromatic polyisocyanates, has been shown to be effective in most instances. The specific ratio for a specific application may be determined by a minimal amount of trial and error, focusing on the aforementioned parameters.

Typically, the image is formed on the image side of the heat transfer paper by passing the ink compound through a screen onto the image side of the heat transfer paper as is known in the art regarding ink alone. Once the ink compound forming the image has been applied to the image side of the heat transfer paper, either preformed or as part of the method of the present invention, powder is applied thereto as seen at step 110 (cross reference FIG. 3*c*). The powder may include thermoplastic co-polyamides, which facilitates the ink compound ultimately adhering to the target surface as described herein.

After powder is applied, at step 115 heat is applied to the heat transfer paper with the ink compound and powder thereon. This application of heat serves to cure or dry the ink compound/powder combination, to facilitate further handling. The heat is applied to the heat transfer paper for at least approximately 2 seconds at a temperature of at least approximately 100 degrees Fahrenheit. The specific time and temperature may vary depending on factors such as the ratio of ink to aromatic polyisocyanates in the ink compound, the material composition of the target surface, the size of the image, etc., and may be determined by a minimal amount of trial and error for a particular application. The heat may be applied in a curing oven. A duration of approximately 2–30 seconds has proven to be effective, at temperatures ranging from 100–350 degrees Fahrenheit. A more specific range of 220–260 degrees Fahrenheit has also been shown to be effective. During the application of heat, it is not required that the temperature remain constant; rather the temperature may increase steadily, decrease steadily, or even fluctuate within the specified ranges.

As thus far described, the image has been prepared for imprinting on a surface. If the target surface is available at this time, the process may continue on to step 125 as indicated by the "Y" branch of decision box 120. If, however, the target surface is not available, or if other circumstances lead to the process ending, the process ends at step 145 as indicated by the "N" branch of decision box 120. The "N" branch may occur, for example, if the image is prepared for imprinting at a first physical location and then applied to a target surface at a second physical location.

Still referring to FIG. 1, the process may now continue at step 125. Alternatively, step 125 may be viewed as the beginning of the imprinting process if, for example, the heat transfer paper with the ink compound and powder thereon is pre-made. At step 125, the image side of the heat transfer paper is positioned against the target surface (cross reference FIG. 3*d*). The target surface is a soft surface, such as: a nylon, polyester, or cotton article; a soft-sewn article; or a polyvinyl chloride (PVC) or PVC derivative article. The surface is typically embodied in a consumer article such as a handbag, backpack, appointment book, carrying bag, sports bag, gym bag, briefcase, luggage, cooler, beverage holder, or a lunch box. A "soft surface" may take many forms, and that phrase is used herein to distinguish from hard services such as wood, metal, hard plastic, and glass. In a typical use, the consumer article is secured to an apparatus before positioning the image side of the heat transfer paper against the surface of the consumer article. The apparatus itself may be embodied within, on, or adjacent a heat/pressure press, and is typically custom-designed to accommodate the particular dimensions and other characteristics of the consumer article.

Once the image side of the heat transfer paper is positioned against the target surface, heat and pressure are applied to the heat transfer paper against the surface as seen at step 130, causing the heat transfer paper with the image thereon to attach to the target surface. The heat and pressure may be applied simultaneously with the positioning of the heat transfer paper against the target surface. In general, "attach" is used in this context to refer to the ink compound and powder combination fusing with or adhering to the target surface due to the chemical properties of the ink compound and powder, as well as the material properties of the target surface. While attachment of an image using heat transfer is generally known in the art, the chemical properties of the ink compound and powder combination described herein result in a superior attachment to the target surface when used as described herein. Upon heating, the target surface is expanded at the molecular level to open up adhesion points or pockets for the ink compound/powder combination to adhere to. This facilitates the image (embodied in the ink compound/powder combination) fusing to the target surface.

During the application of heat and/or pressure, it is not required that the temperature and/or pressure remain constant; rather the temperature and/or pressure may increase steadily, decrease steadily, or even fluctuate within suitable ranges, independent of each other. Further, brief moments in which the temperature and/or pressure reach a level outside a suitable range or upper or lower limit would generally not affect the durability of the final image on the target surface, or otherwise cause a problem with respect to the present invention. Thus for temperature and/or pressure ranges and limits described and claimed herein, Applicants intend such ranges and limits to include processes which may experience such brief moments outside the ranges or limits. The same is true for ranges and limits described and claimed herein with respect to the duration of time associated with a particular event.

Notwithstanding the foregoing, at step 130 the ranges and limits associated with the pressure, time, and temperature may be determined by a minimal amount of trial and error for a particular application. Generally, a pressure of at least approximately 30 pounds per square inch (psi) has been shown to be effective. A range of approximately 30–120 psi may be used. The pressure is applied generally for at least approximately 2 seconds. A range of approximately 2–40 seconds may be used. The pressure is applied generally at a temperature of at least approximately 100 degrees Fahrenheit, or at least approximately 150 degrees Fahrenheit. A range of approximately 100–400 degrees Fahrenheit, or approximately 150–400 degrees Fahrenheit may be used.

After heat and pressure are applied to the heat transfer paper at step 130, causing the ink compound and powder combination embodying the image to attach to the target surface, the heat transfer paper is removed as seen at step 135. Typically, this involves simply peeling the heat transfer paper away (cross reference FIG. 3*e*). The image, having thus been transferred from the heat transfer paper to the target surface, then remains on the target surface. If the article embodying the target surface has been secured to an apparatus, the article is typically disengaged from the apparatus prior to removing the heat transfer paper from the surface. Also, the surface may be let to cool as necessary prior to removing the heat transfer paper. For example, it has been shown to be effective to allow the temperature of the surface to cool to at least as low as 180 degrees Fahrenheit before removing the heat paper from the surface.

Once the heat transfer paper is removed from the target surface and the image thus remains on the target surface (as seen, e.g., in FIG. 3*f*), heat may be applied to the surface embodying the image as seen at step 140. Though this final application of heat is optional, it is preferred because it has been shown to enhance the durability of the image on the target surface due to the expansion of the target surface at the molecular level, which provides the opportunity for the ink compound and powder (embodying the image) to adhere to the target surface. The aforementioned results of heating the surface at this stage in the process facilitate the image (embodied in the ink compound/powder combination) attaching to the target surface by a sort of fusing process, resulting in a durability not heretofore attainable, especially in the case in which the target surface is PVC or a PVC derivative. In addition, the final heating process causes small traces of excess powder to evaporate. The surface may be heated in a curing tunnel. The product with the image thus imprinted thereon is then ready to cool, pack, and distribute.

The temperature and time variables for applying heat to the surface after removing the heat transfer paper may be determined for a particular application with a minimal amount of trial and error. It has been shown to be effective to apply heat for at least approximately 10 seconds at a temperature of at least approximately 220 degrees Fahrenheit. A range of 10–60 seconds and 220–400 degrees Fahrenheit may be used. After step 135, or optionally after step 140, and once the article embodying the image has cooled to a suitable temperature if necessary, the article is then ready for packing and shipping as the case may be.

In a particular application using a typical PVC or PVC derivative target surface, the following values have been shown to be effective: 1) the ratio of ink to aromatic polyisocyanates in the ink compound is approximately 14–16 to 1; 2) at step 115 heat is applied for approximately 2–15 seconds at a temperature of approximately 220–400 degrees Fahrenheit; 3) at step 130 a pressure of approximately 60–100 psi is applied at a temperature of approximately 250–295 degrees Fahrenheit for approximately 4–10 seconds; 4) at step 140 heat is applied to the surface at a temperature of approximately 275–325 degrees Fahrenheit for approximately 20–40 seconds. Again, however, fluctuations are not unusual for any particular application, and the aforementioned values should be used as a possible starting point to determine the best values for any particular application, using a minimal amount of trial and error.

Figure 2:
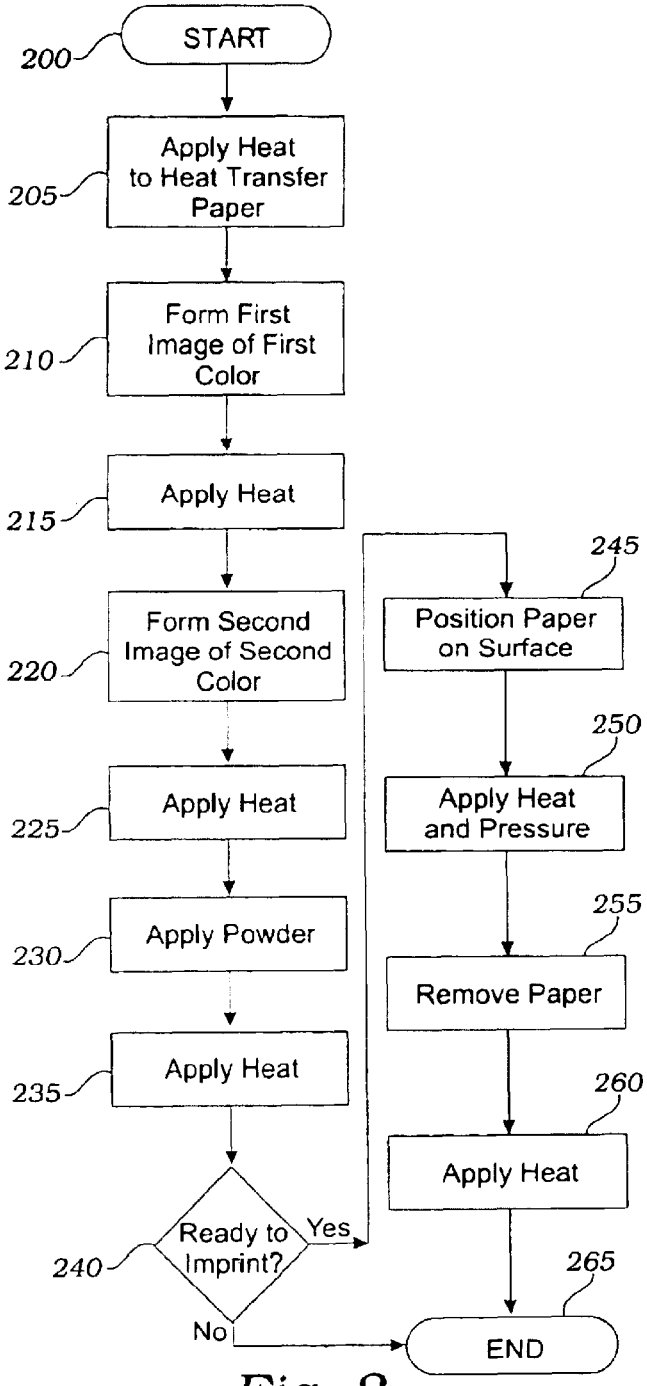
FIG. 2 is a flowchart illustrating a method of imprinting a multi-color image on a soft surface in accordance with the present invention.

Turning now to FIG. 2, a flowchart is shown illustrating a method of imprinting a multi-color image on a soft surface in accordance with the present invention. The pressure, temperature, and time ranges and limits described in connection with imprinting a single-color image on a surface, apply for analogous steps to the method of imprinting a multi-color image on a surface as well. Similarly, the ink compound and powder used are the same as described in connection with imprinting a single-color image, although there are multiple ink compounds used corresponding to the multiple colors of the multi-color image. There are, however, some distinctions which will be pointed out below. For example, the heat transfer paper is preheated before application of any ink compound thereto (see step 205), heat is applied to the heat transfer paper after application of each color to the heat transfer paper (see steps 215 and 225), and the powder is applied preferably only after all colors have been applied to the heat transfer paper (see step 230).

As used herein, references to a first image, a second image, etc., are to distinguish a first portion of a multi-color image formed using a first color, from a second portion of a multi-color image formed using a second color, etc. For example, as seen in FIG. 3*b*, a first image 10 is a first color, a second image 10*a* is a second color, and a third image 10*b* is a third color, each applied separately as described herein, wherein images 10, 10*a*, and 10*b* together form a desired multi-color image.

The process for imprinting a multi-color image begins at step 200. At step 205, heat is applied to the heat transfer paper prior to any ink compound being applied thereto. Alternatively, it may simply be verified or ensured that this step of preheating has already occurred such that the heat transfer paper does not need to be preheated again before proceeding to step 210. The alternative case may occur, for example, if the heat transfer paper has been pre-heated in preparation for use in accordance with the present invention, even though such pre-heating may have occurred at a previous time and/or place. The goal of the pre-heating (or of the heating as the start of the method being described) is to shrink the paper to a degree such that further shrinkage between color applications is eliminated or at least reduced. Such shrinkage between color applications might otherwise cause misalignment of the various colors with respect to the target multi-color image. The heat applied at step 205 is typically done slowly enough to remove moisture from the paper, at temperatures high enough to do so without burning the paper (e.g., approximately 100 degrees Fahrenheit).

Once the heat transfer paper is pre-heated at step 205, or provided after such pre-heating, a first image is formed on the image side of the heat transfer paper using a first ink compound of a first color, as seen at step 210 (see, e.g., first image 10 in FIG. 3*b*). The first image is formed in a manner similar to forming the single-color image as described herein. Even though no powder is yet applied to the heat transfer paper, heat is then applied to the heat transfer paper at step 215, in a manner similar to step 115 associated with preparing a single-color image for imprinting at a point in which powder would have already been applied to the heat transfer paper. At step 220 a second image is formed on the image side of the heat transfer paper using a second ink compound of a second color (see, e.g., 10*a* in FIG. 3*b*). The second image is formed in a manner similar to forming the first image, although typically a first screen is used to form the first image and a second screen is used to form the second image. Heat is then applied to the heat transfer paper having the first ink compound and the second ink compound thereon, as seen at step 225, similar to the application of heat at step 215. Additional images of new (or repeated) colors may be formed in like manners (see, e.g., 10*b* in FIG. 3*b*), applying heat after application of each additional color.

Once all of the different-colored ink compounds used to form the multi-color image have been applied to the heat transfer paper as thus far described, powder is applied to the multi-color image as seen at step 230, similar to the application of powder as described at step 110 in connection with preparing a single-color image for imprinting. Heat is then applied to the heat transfer paper again, as seen in step 235, similar to the application of heat as described at step 115 in connection with preparing a single-color image for imprinting.

As thus far described, the multi-color image has been prepared for imprinting on a surface. If the target surface is available at this time, the process may continue on to step 245 as indicated by the "Y" branch of decision box 240. If, however, the target surface is not available, or if other circumstances lead to the process ending, the process ends at step 265 as indicated by the "N" branch of decision box 240. The "N" branch may occur, for example, if the image is prepared for imprinting at a first physical location and then applied to a target surface at a second physical location.

Still referring to FIG. 2, the process may now continue at step 245. Alternatively, step 245 may be viewed as the beginning of the imprinting process if, for example, the heat transfer paper with the ink compounds and powder thereon is pre-made. At step 245, the image side of the heat transfer paper is positioned against the target surface, similar to step 125 as described herein in connection with imprinting a single-color image on a surface.

Once the image side of the heat transfer paper is positioned against the target surface, heat and pressure are applied to the heat transfer paper against the surface as seen at step 250, causing the heat transfer paper with the ink compounds and powder thereon, embodying the multi-color image, to attach to the target surface, similar to step 130 as described herein in connection with imprinting a single-color image on a surface. The heat and pressure may be applied simultaneously with the positioning of the heat transfer paper against the target surface.

After heat and pressure are applied to the heat transfer paper at step 250, causing the ink compounds and powder embodying the multi-color image to attach to the target surface, the heat transfer paper is removed as seen at step 255, similar to step 135 as described herein in connection with imprinting a single-color image on a surface. Once the heat transfer paper is removed from the target surface and the multi-color image thus remains on the target surface, heat may be applied to the surface embodying the multi-color image as seen at step 260, similar to step 140 as described herein in connection with imprinting a single-color image on a surface. The product with the multi-color image thus imprinted thereon is then ready to cool, pack, and distribute.

Turning now to FIGS. 3*a*–3*f*, various stages of a method of imprinting an image 10 on a soft surface in accordance with the present invention are illustrated (optionally together with a second image 10*a*, and/or a third image 10*b* in the case of imprinting a multi-color image.) FIG. 3*a* shows a blank sheet of heat transfer paper 5. That is, no ink compounds have yet been applied thereto. FIG. 3*b* shows the sheet of heat transfer paper 5 after an image 10 has been formed on the image side 20 thereof (cross reference step 105 of FIG. 1). FIG. 3*b* also shows additional images, second image 10*a* and third image 10*b*, applied to the heat transfer paper 5, as would be the case in preparing a multi-color image for imprinting on a surface (cross reference step 220 of FIG. 2).

The example in FIG. 3 continues regarding only the single color image 10, for simplicity of illustration. FIG. 3*c* shows the sheet of heat transfer paper 5 after image 10 has been formed thereon and powder 15 has been applied to image 10 (cross reference step 110 of FIG. 1). FIG. 3*d* shows the sheet of heat transfer paper 5 placed against the target surface 25, image side down (cross reference step 125 of FIG. 1). FIG. 3*e* shows the sheet of heat transfer paper 5 being lifted away from the target surface 25 as indicated by directional arrow 30, leaving image 10 on the surface 25 as seen in FIG. 3*f* (cross reference step 135 of FIG. 1). Note image 10 in FIG. 3*f* is the reverse of image 10 in FIG. 3*b*

While certain embodiments are illustrated in the drawings and are described herein, including preferred embodiments, it will be apparent to those skilled in the art that the specific embodiments described herein may be modified without departing from the inventive concepts described.

For example, Applicants have used the phrases "approximately" and/or "at least approximately" when referring to pressure, temperature, and time variables, because the values of the desired limits and/or ranges are not required to be exact, and also because the values may be determined by a minimal amount of trial and error for any particular application to accomplish the desired results. The results are evident by examining the target surface after imprinting the image thereon.

As another example, though Applicants have not listed every possible combination of limits and/or ranges of pressure, temperature, and/or duration, it is to be understood that smaller or more exact ranges within the ranges provided are acceptable, as are more exact limits within it the limits specified acceptable. For example, Applicants have specified ink compounds having a ratio of approximately 2–40 parts ink to 1 part aromatic polyisocyanates. Thus, any ratio from approximately 2 to 1, up to 40 to 1, may be suitable for a particular application. Similarly, Applicants have specified a range of approximately 30–120 psi of pressure to be applied in certain instances, and it is to be understood that any range within that range (such as 30–100 psi, or 45–100 psi, or 50–75 psi, etc.) may also be suitable for a particular application.

Accordingly, applicants' invention as described herein is not to be restricted, except in accordance with the law by the claims which follow.

What is claimed is:

1. A method of preparing an image for imprinting on a soft surface comprising the steps:

providing an image on an image side of a heat transfer paper, said image comprising an ink compound;

applying powder to the image; and applying heat to the heat transfer paper after applying the powder to the image;

wherein the ink compound comprises ink and aromatic polyisocyanates; and wherein said ink compound and powder are such that said image can be imprinted on said soft surface with heat applied to said heat transfer paper at a temperature in the range of 250 to 295 degrees Fahrenheit for up to 10 seconds.

2. The method of claim 1, wherein the ink compound comprises ink and aromatic polyisocyanates in a ratio of at least approximately 2 parts ink to 1 part aromatic polyisocyanates.

3. The method of claim 1, wherein the heat is applied to the heat transfer paper for at least approximately 2 seconds at a temperature of at least approximately 100 degrees Fahrenheit.

4. The method of claim 1, wherein the image is provided on the image side of the heat transfer paper by passing the ink compound through a screen onto the image side of the heat transfer paper.

5. The method of claim 1, wherein the powder comprises thermoplastic co-polyamides.

6. The method of claim 1, wherein the ink comprises polyvinyl chloride plastisol silk screen ink.

7. The method of claim 3, wherein the image is provided on the image side of the heat transfer paper by passing the ink compound through a screen onto the image side of the heat transfer paper.

8. The method of claim 1, further comprising the steps of:

positioning the image side of the heat transfer paper against a soft surface;

applying heat and pressure to the heat transfer paper against the surface, causing the heat transfer paper with the ink compound and the powder thereon to attach to the surface; and removing the heat transfer paper from the surface after applying the heat and the pressure to the heat transfer paper against the surface, in a manner such that the image remains on the surface.

9. The method of claim 8, further comprising the step of applying heat to the surface after removing the heat transfer paper from the surface.

10. The method of claim 9, wherein heat is applied to the surface after removing the heat transfer paper from the surface, for at least approximately 10 seconds at a temperature of at least approximately 220 degrees Fahrenheit.

11. The method of claim 9, wherein the heat is applied to the heat transfer paper after applying the powder to the image, for at least approximately 2 seconds at a temperature of at least approximately 100 degrees Fahrenheit.

12. The method of claim 9, wherein heat is applied to the surface in a curing tunnel.

13. The method of claim 8, further comprising the step of ensuring the temperature of the surface is at least as low as 180 degrees Fahrenheit before removing the heat transfer paper.

14. The method of claim 8, wherein the pressure applied is at least approximately 30 pounds per square inch.

15. The method of claim 8, wherein the pressure is applied for at least approximately 2 seconds.

16. The method of claim 8, wherein the pressure is applied at a temperature of at least approximately 150 degrees Fahrenheit.

17. The method of claim 8, wherein the pressure applied is within a range of approximately 30–120 pounds per square inch, and the pressure is applied for approximately 2–40 seconds at a temperature within a range of approximately 150–400 degrees Fahrenheit.

18. The method of claim 8, wherein the surface is on a consumer article, and further comprising the step of securing the consumer article to an apparatus before positioning the image side of the heat transfer paper against the surface.

19. A method of preparing a multi-color image for imprinting on a soft surface comprising the steps:

forming a first image on an image side of a heat transfer paper using a first ink compound;

forming a second image on the image side of the heat transfer paper using a second ink compound, after forming the first image;

verifying heat is applied to the heat transfer paper before forming the first image thereon;

applying heat to the heat transfer paper after forming the first image but before forming the second image;

applying heat to the heat transfer paper after forming the second image;

applying powder to the first and second images after forming the second image; and applying heat to the heat transfer paper after applying the powder to the first and second images;

wherein the first ink compound comprises ink and aromatic polyisocyanates; and wherein the second ink compound comprises ink and aromatic polyisocyanates; and wherein the first ink compound is a first color, and the second ink compound is a second color, whereby the first image and the second image together form a multi-color image; and wherein said first ink compound and powder are such that said image can be imprinted on said soft surface with heat applied to said heat transfer paper at a temperature in the range of 250 to 295 degrees Fahrenheit for up to 10 seconds.

20. The method of claim 19, wherein the first ink compound comprises ink and aromatic polyisocyanates in a ratio of at least approximately 2 parts ink to 1 part aromatic polyisocyanates, and wherein the second ink compound comprises ink and aromatic polyisocyanates in a ratio of at least approximately 2 parts ink to 1 part aromatic polyisocyanates.

21. The method of claim 19, wherein the heat is applied to the heat transfer paper after forming the first image but before forming the second image, and after forming the second image, each for at least approximately 2 seconds at a temperature of at least approximately 100 degrees Fahrenheit.

22. The method of claim 19, wherein the powder comprises thermoplastic co-polyamides.

23. The method of claim 19, wherein the ink comprises polyvinyl chloride plastisol silk screen ink.

24. The method of claim 19, wherein the first image is formed on the image side of the heat transfer paper by passing the first ink compound through a first screen onto the image side of the heat transfer paper, and wherein the second image is formed on the image side of the heat transfer paper by passing the second ink compound through a second screen onto the image side of the heat transfer paper.

25. The method of claim 19, wherein the heat is applied to the heat transfer paper after applying the powder to the multi-color image, for at least approximately 2 seconds at a temperature of at least approximately 100 degrees Fahrenheit.

26. The method of claim 19, further comprising the steps:

positioning the image side of the heat transfer paper against a soft surface;

applying heat and pressure to the heat transfer paper against the surface, causing the heat transfer paper with the first ink compound, the second ink compound, and the powder thereon, to attach to the surface; and removing the heat transfer paper from the surface after applying the heat and the pressure to the heat transfer paper against the surface, in a manner such that the multi-color image remains on the surface.

27. The method of claim 26, further comprising the step of applying heat to the surface after removing the heat transfer paper from the surface.

28. The method of claim 27, wherein heat is applied to the surface after removing the heat transfer paper from the surface, for at least approximately 10 seconds at a temperature of at least approximately 220 degrees Fahrenheit.

29. The method of claim 27 wherein heat is applied to the surface in a curing tunnel.

30. The method of claim 26, wherein the heat is applied to the heat transfer paper after applying the powder to the multi-color image, for at least approximately 2 seconds at a temperature of at least approximately 100 degrees Fahrenheit.

31. The method of claim 26 further comprising the step of ensuring the temperature of the surface is at least as low as 180 degrees Fahrenheit before removing the heat transfer paper.

32. The method of claim 26 wherein the pressure applied is at least approximately 30 pounds per square inch.

33. The method of claim 26, wherein the pressure is applied for at least approximately 2 seconds.

34. The method of claim 26, wherein the pressure is applied at a temperature of at least approximately 150 degrees Fahrenheit.

35. The method of claim 26, wherein the pressure applied is in a range of approximately 30–120 pounds per square inch, and the pressure is applied for approximately 2–40 seconds at a temperature within a range of approximately 100–400 degrees Fahrenheit.

36. A method of imprinting an image on a soft surface comprising the steps:

providing an image on an image side of a heat transfer paper;

positioning the image side of the heat transfer paper against a surface;

applying heat and pressure to the heat transfer paper against the surface, causing the heat transfer paper with the image thereon to attach to the surface; and removing the heat transfer paper from the surface after applying the heat and the pressure to the heat transfer paper against the surface, in a manner such that the image remains on the surface;

wherein the image is formed on the image side of the heat transfer paper using an ink compound, and is coated with a powder and then heated for at least approximately 2 seconds at a temperature of at least approximately 100 degrees Fahrenheit, prior to positioning the image side of the heat transfer paper against the surface;

wherein the ink compound comprises ink and aromatic polyisocyanates; and wherein said first ink compound and powder are such that said image can be imprinted on said soft surface with heat applied to said heat transfer paper at a temperature in the range of 250 to 295 degrees Fahrenheit for up to 10 seconds.

37. The method of claim 36, further comprising the step of applying heat to the surface after removing the heat transfer paper from the surface.

38. The method of claim 37, wherein heat is applied to the surface after removing the heat transfer paper from the surface, for at least approximately 10 seconds at a temperature of at least approximately 220 degrees Fahrenheit.

39. The method of claim 36, wherein the ink compound comprises ink and aromatic polyisocyanates in a ratio of at least approximately 2 parts ink to 1 part aromatic polyisocyanates.

40. The method of claim 36, wherein the powder comprises thermoplastic co-polyamides.

41. The method of claim 36, wherein the ink comprises polyvinyl chloride plastisol silk screen ink.

42. A method of imprinting a multi-color image on a soft surface comprising the steps:

forming a first image on an image side of a heat transfer paper using a first ink compound;

forming a second image on the image side of the heat transfer paper using a second ink compound, after forming the first image;

wherein the first ink compound is a first color, and the second ink compound is a second color, whereby the first image and the second image together form a multi-color image;

verifying heat is applied to the heat transfer paper before forming the first image thereon;

applying heat to the heat transfer paper after forming the first image but before forming the second image, for at least approximately 2 seconds at a temperature of at least approximately 100 degrees Fahrenheit;

applying heat to the heat transfer paper after forming the second image, for at least approximately 2 seconds at a temperature of at least approximately 100 degrees Fahrenheit;

applying powder to the multi-color image;

applying heat to the heat transfer paper after applying the powder to the multi-color image, for at least approximately 2 seconds at a temperature of at least approximately 100 degrees Fahrenheit;

positioning the image side of the heat transfer paper against a surface;

applying heat and pressure to the heat transfer paper against the surface, said heat applied to said heat transfer paper at a temperature in the range of 250 to 295 degrees Fahrenheit for up to 10 seconds; causing the heat transfer paper with the first ink compound, the second ink compound, and the powder thereon, to attach to the surface; and removing the heat transfer paper from the surface after applying the heat and the pressure to the heat transfer paper against the surface, in a manner such that the multi-color image remains on the surface;

wherein the first ink compound comprises ink and aromatic polyisocyanates; and wherein the second ink compound comprises ink and aromatic polyisocyanates.

43. The method of claim 42, further comprising the step of applying heat to the surface after removing the heat transfer paper from the surface.

44. The method of claim 43, wherein heat is applied to the surface after removing the heat transfer paper from the surface, for at least approximately 10 seconds at a temperature of at least approximately 220 degrees Fahrenheit.

45. The method of claim 42, wherein the first ink compound comprises ink and aromatic polyisocyanates in a ratio of at least approximately 2 parts ink to 1 part aromatic polyisocyanates, and wherein the second ink compound comprises ink and aromatic polyisocyanates in a ratio of at least approximately 2 parts ink to 1 part aromatic polyisocyanates.

46. The method of claim 42, wherein the powder comprises thermoplastic co-polyamides.

47. The method of claim 42, wherein the ink comprises polyvinyl chloride plastisol silk screen ink.

48. The method of claim 42, further comprising the step of ensuring the temperature of the surface is at least as low as 180 degrees Fahrenheit before removing the heat transfer paper.

49. The method of claim 42, wherein the pressure applied is at least approximately 30 pounds per square inch, for at least approximately 2 seconds, at a temperature of at least approximately 100 degrees Fahrenheit.

50. The method of claim 42, wherein the pressure applied is in a range of approximately 30–120 pounds per square inch, and the pressure is applied for approximately 2–40 seconds at a temperature within a range of approximately 100–400 degrees Fahrenheit.

51. A method of preparing an image for imprinting on a soft surface comprising the steps:

providing an image on an image side of a heat transfer paper, said image comprising an ink compound;

applying powder to the image; and applying heat to the heat transfer paper after applying the powder to the image wherein said heat is applied at a temperature in the range of 220 to 400 degrees Fahrenheit for between 2 to 15 seconds;

wherein the ink compound comprises ink and aromatic polyisocyanates; and wherein said ink compound and powder are such that said image can be imprinted on said soft surface with heat applied to said heat transfer paper at a temperature in the range 250 to 295 degrees Fahrenheit for up to 10 seconds.

52. The method of claim 51 wherein said soft surface is polyvinyl chloride.

* * * * *